US008662844B2

(12) United States Patent
Hada et al.

(10) Patent No.: US 8,662,844 B2
(45) Date of Patent: Mar. 4, 2014

(54) TURBINE VANE AND GAS TURBINE

(75) Inventors: Satoshi Hada, Takasago (JP); Keizo Tsukagoshi, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 1003 days.

(21) Appl. No.: 12/644,633

(22) Filed: Dec. 22, 2009

(65) Prior Publication Data

US 2011/0123351 A1 May 26, 2011

(30) Foreign Application Priority Data

May 11, 2009 (JP) ..... 2009-114641

(51) Int. Cl.
*F01D 5/18* (2006.01)

(52) U.S. Cl.
USPC ..... 416/96 A

(58) Field of Classification Search
USPC ..... 416/96 A, 233, 97 R; 415/115
See application file for complete search history.

(56) References Cited

U.S. PATENT DOCUMENTS

| | | | | | |
|---|---|---|---|---|---|
| 2,489,683 | A | * | 11/1949 | Stalker | 60/726 |
| 3,246,469 | A | * | 4/1966 | Moore | 60/265 |
| 4,252,501 | A | | 2/1981 | Peill | |
| 4,312,624 | A | | 1/1982 | Steinbauer, Jr. et al. | |
| 5,193,980 | A | | 3/1993 | Kaincz et al. | |
| 5,591,002 | A | * | 1/1997 | Cunha et al. | 415/115 |
| 5,645,397 | A | | 7/1997 | Soechting et al. | |
| 5,762,471 | A | | 6/1998 | Cunha | |
| 5,772,398 | A | | 6/1998 | Noiret et al. | |
| 7,497,655 | B1 | | 3/2009 | Liang | |
| 2001/0051095 | A1 | | 12/2001 | Schotsch et al. | |
| 2002/0085908 | A1 | | 7/2002 | Tiemann | |
| 2003/0170113 | A1 | | 9/2003 | Burdgick et al. | |

FOREIGN PATENT DOCUMENTS

| | | | |
|---|---|---|---|
| CN | 1477292 | A | 2/2004 |
| EP | 0 785 339 | A1 | 7/1997 |
| EP | 1 088 966 | A2 | 4/2001 |
| EP | 1852572 | A2 | 11/2007 |
| FR | 2457965 | A | 12/1980 |
| FR | 2672338 | A1 | 8/1992 |

(Continued)

OTHER PUBLICATIONS

International Search Report of PCT/JP2009/070983, date of mailing Mar. 16, 2010.

Japanese Decision to Grant a Patent dated Sep. 11, 2012, issued in corresponding Japanese patent application No. 2011-513209, w/ partial English translation.

Chinese Office Action dated Dec. 25, 2012, issued in corresponding Chinese Patent Application No. 200980147043.X, w/ English translation.

(Continued)

*Primary Examiner* — Nathaniel Wiehe
*Assistant Examiner* — Adam W Brown
(74) *Attorney, Agent, or Firm* — Westerman, Hattori, Daniels & Adrian, LLP

(57) ABSTRACT

An airfoil part includes a plurality of cooling chambers that are spaces into which the inside of the airfoil part is partitioned, from a leading edge side to a trailing edge side, by a partition wall, that extend in a vane-longitudinal-section direction, and that include division parts on inner walls of a body; insert cylinders that are disposed in the cooling chambers and that have a plurality of impingement holes; and film holes that are provided in the body. The insert cylinders include partitioning parts that extend from the leading edge side to the trailing edge side and that extend in the vane-longitudinal-section direction. The insides of the insert cylinders are partitioned into pressure-surface-side insert spaces close to a pressure surface and suction-surface-side insert spaces close to a suction surface.

5 Claims, 7 Drawing Sheets

(56) References Cited

FOREIGN PATENT DOCUMENTS

| | | | |
|---|---|---|---|
| GB | 1587401 | A | 4/1981 |
| JP | 9-112205 | A | 4/1997 |
| JP | 9-209707 | A | 8/1997 |
| JP | 2001-65305 | A | 3/2001 |
| JP | 2001-98905 | A | 4/2001 |
| JP | 2001-140602 | A | 5/2001 |
| JP | 2002-161705 | A | 6/2002 |
| JP | 2003-286805 | A | 10/2003 |
| JP | 2008-274906 | A | 11/2008 |

OTHER PUBLICATIONS

Korean Notice of Allowance dated Dec. 17, 2012, issued in corresponding Korean patent application No. 10-2011-7012166, w/ English translation.

Extended European Search Report dated Jul. 11, 2013, issued in corresponding European Patent Application No. 09844655.2 (6 pages).

Notification of Grant of Invention Patent dated Jun. 5, 2013, issued in corresponding Chinese Patent Application No. 200980147043.X (2 pages), with concise explanation of relevance attached.

* cited by examiner

TURBINE VANE AND GAS TURBINE

CROSS REFERENCE TO RELATED APPLICATIONS

This application claims benefit of Japanese Application No. 2009-114641 filed in Japan on May 11, 2009, the contents of which is hereby incorporated by its reference.

BACKGROUND OF THE INVENTION

1. Field of the Invention

The present invention relates to a turbine vanes having a cooling structure in a gas turbine and to a gas turbine.

2. Description of Related Art

In general, turbine blades and turbine vanes in gas turbines usually include cooling structures therein because they are used in high-temperature environments.

A known example for cooling turbine vanes is a configuration in which two or three cavities through which cooling air passes are provided and inserts (insert cylinders) are disposed in these cavities (see U.S. Pat. No. 4,312,624, Japanese Unexamined Patent Application, Publication No. 2002-161705, Japanese Unexamined Patent Application, Publication No. 2003-286805, and Japanese Unexamined Patent Application, Publication No. Hei-09-112205, for example).

In the case of the above-described configuration, one space (cavity) is basically formed between each of the inserts and the inner wall of each of the cavities. To control pressures in respective areas inside the cavity at different values, a method in which sealing dams or the like for partitioning this cavity are provided is known.

Cooling air for the turbine vane is supplied to the insides of the inserts at the same pressure as in a casing. The cooling air is blown out through a number of small holes formed in the inserts toward the inner walls of the above-described cavities and is used for cooling the turbine vane (impingement cooling).

The cooling air used for the impingement cooling blows out from the cavities to the outside of the turbine vane through through-holes connecting the cavities to the outside of the turbine vane. The blown-out cooling air covers the outer surface of the turbine vane like a film, thereby reducing the inflow of heat from high-temperature gas to the turbine vane (film cooling).

In order to properly carry out the above-described film cooling, it is necessary to reduce the pressure difference between the insides of the cavities and the outside of the turbine vane as much as possible.

FIG. 7 is a vane transverse sectional view of a conventional turbine vane 60.

In an airfoil part 61 forming a body 71 of the turbine vane 60, a plurality of cooling chambers C1, C2, and C3 are disposed from a leading edge LE to a trailing edge TE, and inserts 81 are arranged in the respective cooling chambers. Cooling air supplied to the airfoil part 61 is supplied to the inserts 81, blows out through impingement holes 84 provided in the inserts 81 to cavity spaces (spaces surrounded by inner walls 71*a* of the body 71 and the inserts 81), and is used to cool the inner walls 71*a* of the body 71. Then, the cooling air is discharged through film holes 73 provided in the airfoil part 61 into combustion gas, and is used to film-cool an outer wall 71*b* of the body 71 of the airfoil part 61.

However, as shown in FIG. 7, the outer surface of the airfoil part 61 of the turbine vane 60 along which combustion gas flows generally has a low combustion-gas pressure at a suction surface SS side where the blade is curved in a convex shape and has a high combustion-gas pressure at a pressure surface PS side where it is curved in a concave shape. Therefore, in order to maintain an appropriate pressure difference (film pressure difference) between the film holes at both sides, the pressures in the cavity spaces, which are communicated to combustion gas through the film holes 73, are high at the pressure surface PS side and are low at the suction surface SS side.

Specifically, the velocity of cooling air blowing out through the impingement holes 84 in the inserts 81 to the cavity spaces is low at the pressure surface PS side and is high at the suction surface SS side. Therefore, it is likely to excessively cool the suction surface SS side of the body, compared with the pressure surface PS side thereof.

To suppress this phenomenon, protrusion-like sealing dams 72 extending in a vane-longitudinal-section direction are provided on the inner walls 71*a* of the body 71 at the leading edge LE side and at the trailing edge TE side, so as to partition the cavity spaces into pressure-surface-side cavity spaces CP and suction-surface-side cavity spaces CS. In each of the cooling chambers, the sealing dams 72 are disposed at at least two positions (on the inner wall 71*a* or a partition wall P, close to the leading edge LE and the trailing edge TE).

The sealing dams 72 are designed to support the insert 81 from the inner wall 71*a* side of the body 71 and are also designed to separate the cavity space into the pressure-surface-side cavity space CP and the suction-surface-side cavity space CS to prevent the pressure-surface-side cavity space CP from communicating with the suction-surface-side cavity space CS, thus making the pressures in the cavity spaces different between the pressure surface PS side and the suction surface SS side.

These sealing dams 72 are protrusions extending in the vane-longitudinal-section direction along the inner walls 71*a* of the body 71 that are close to the leading edge LE and the trailing edge TE, and have concave grooves 72*a* at the centers in cross sections of the sealing dams 72, along the vane-longitudinal-section direction.

On the other hand, at the leading edge LE side and the trailing edge TE side on the outer surface of the insert 81 (surface opposed to the inner wall 71*a* of the body 71), at least two flange parts 83 extending in the vane-longitudinal-section direction and in the vane-transverse-section direction are provided; and the flange parts 83 are inserted into the concave grooves 72*a* of the sealing dams 72. The flange parts 83 and the sealing dams 72 are brought into contact in the concave grooves 72*a*, so as to separate the pressure-surface-side cavity space CP having a high pressure from the suction-surface-side cavity space CS having a low pressure, thus sealing the pressure difference between both spaces.

Referring to FIG. 7, a description will be given below of the flow of cooling air blowing out from the insert 81 to the cavity spaces through the impingement holes 84 and discharged into combustion gas through the film holes 73 provided in the airfoil part 61.

Combustion gas flowing along the outer wall 71*b* of the turbine vane 60 has a high pressure at the pressure surface PS side and has a low pressure at the suction surface SS side. Cooling air for cooling the body 71 is supplied to the insert 81 at a higher pressure than the pressures of the combustion gas. The cooling air blows out to the pressure-surface-side cavity space CP and the suction-surface-side cavity space CS through the impingement holes 84 provided in the insert 81, thus impingement-cooling the inner walls 71*a* of the body 71.

Further, the cooling air blowing out from the insert 81 to the pressure-surface-side cavity space CP is discharged into combustion gas through the film holes 73 provided at the pressure surface PS side of the body 71 of the airfoil part 61. The cooling air blowing out to the suction-surface-side cavity space CS is discharged into combustion gas through the film holes 73 provided at the suction surface SS side of the airfoil part 61. Due to the pressure difference between combustion gas flowing in the pressure surface PS side of the body 71 and that flowing in the suction surface SS side thereof, the pressure in the pressure-surface-side cavity space CP becomes higher than the pressure in the suction-surface-side cavity space CS.

However, in the conventional example shown in FIG. 7, one insert 81 is disposed in each of the cooling chambers C1, C2, and C3, and cooling air supplied to the insert 81 is supplied to the pressure-surface-side cavity space CP and the suction-surface-side cavity space CS through the impingement holes 84, is used to cool the inner walls 71*a* of the body 71, and is then used to film-cool the outer surface of the airfoil part 61. However, when only one insert 81 is provided in each cooling chamber, it is difficult to carry out appropriate film cooling.

Specifically, in the above-described configuration, since the pressure surface PS side of the body 71, which is located at the upstream side of combustion gas, has a higher temperature than the suction surface SS side of the body 71, which is located at the downstream side of the combustion gas, it is necessary to enhance impingement-cooling for the pressure surface PS of the body 71 more than that for the suction surface SS of the body 71.

On the other hand, since the pressure-surface-side cavity space CP has a higher pressure than the suction-surface-side cavity space CS, the pressure difference with respect to the insert 81 is low in the pressure-surface-side cavity space CP and is high in the suction-surface-side cavity space CS. Therefore, in order to sufficiently apply impingement-cooling to the inner wall 71*a* of the body 71 at the pressure surface PS, it is necessary to increase the number of the impingement holes 84 that communicate with the pressure-surface-side cavity space CP and to reduce the number of the impingement holes 84 that communicate with the suction-surface-side cavity space CS.

Without such hole-count adjustment, impingement-cooling for the suction surface SS of the body is enhanced, compared with that for the pressure surface PS of the body, and the amount of cooling air for the suction surface SS is increased. In other words, the amount of air used for impingement-cooling the suction surface SS becomes excessive with respect to the pressure surface PS, the suction surface SS of the body is excessively cooled, and the amount of cooling air for the entire blade is increased, thus reducing the cooling efficiency of the gas turbine.

However, when the number of impingement holes on the suction surface SS of the body is reduced more than the number of impingement holes on the pressure surface PS of the body, the pitch of impingement holes is increased at the suction surface SS of the body, thus causing a temperature variation in the body and increasing the thermal stress on the body.

Further, as described above, since the pressure in the pressure-surface-side cavity space CP is higher than the pressure in the suction-surface-side cavity space CS, the pressure difference with respect to the insert 81 is low in the pressure-surface-side cavity space CP and is relatively high in the suction-surface-side cavity space CS. Therefore, as shown in dashed lines 82 in FIG. 7, the suction surface SS of the insert 81 expands outward in a vane transverse cross section, causing a problem of deformation of the whole insert.

Further, when the insert is deformed, the seal gap between the flange parts 83 of the insert and the concave grooves 72*a* of the sealing dams 72 deteriorate, and, as indicated by the direction of arrows in FIG. 7, cooling air leaks from the pressure-surface-side cavity space CP toward the suction-surface-side cavity space CS, causing a problem of deterioration of the seal gap between the suction side cavity and the pressure side cavity.

In order to suppress the deformation of the insert, a method of improving the strength of the insert by providing ribs or dimples on the insert or a method of improving the strength of the insert by increasing the plate thickness of the insert can be used. However, these methods of improving the strength of the insert cause a problem in manufacturability of the inserts.

In addition to the cooling chamber C1, which is closest to the leading edge LE, shown in FIG. 7, the adjacent cooling chamber CS2 also has the above-described problems.

BRIEF SUMMARY OF THE INVENTION

The present invention has been made to solve the above-described problems, and an object thereof is to provide a turbine vane and a gas turbine that realize appropriate impingement cooling for a body by selecting appropriate pressure difference between insert spaces and pressure-surface-side cavity spaces and between insert spaces and suction-surface-side cavity spaces, and that can improve the cooling properties of film cooling for an airfoil part by suppressing deformation of inserts.

In order to achieve the above-mentioned object, the present invention provides the following solutions.

According to a first aspect, the present invention provides a turbine vane including: an airfoil part that has a pressure surface curved in a concave shape and a suction surface curved in a convex shape; an outer shroud that is supported by a turbine casing; and an inner shroud that is connected to the outer shroud via the airfoil part, in which: the airfoil part includes: a plurality of cooling chambers that are spaces into which the inside of the airfoil part is partitioned, from a leading edge side to a trailing edge side, by a partition wall, that extend in a vane-longitudinal-section direction, and that include division parts on inner walls of a body; insert cylinders that are disposed in the cooling chambers and that have a plurality of impingement holes; and film holes that are provided in the body; the insert cylinders include partitioning parts that extend from the leading edge side to the trailing edge side and that extend in the vane-longitudinal-section direction; and the insides of the insert cylinders are partitioned into pressure-surface-side insert spaces close to the pressure surface and suction-surface-side insert spaces close to the suction surface.

According to the turbine vane of the first aspect of the present invention, cooling fluid having different pressures can be supplied to the pressure-surface-side insert spaces and the suction-surface-side insert spaces. Therefore, appropriate pressure difference can be selected between the pressure-surface-side insert spaces and the pressure-surface-side cavity spaces and between the suction-surface-side insert spaces and the suction-surface-side cavity spaces.

Here, each of the pressure-surface-side cavity spaces is the space on the pressure surface side of two spaces that are divided by the division parts and are located between a cooling chamber and an insert cylinder, and each of the suction-surface-side cavity spaces is the space on the suction-surface-side thereof.

Therefore, the number of the impingement holes formed in the insert cylinders can be specified to an appropriate value. In particular, the number of the impingement holes between the suction-surface-side insert spaces and the suction-surface-side cavity spaces, where the pressure difference is likely to increase, can be increased, so as to improve the cooling properties based on impingement cooling. As a result, the thermal stress on the body is relieved, thus reducing the amount of cooling air for the entire blade.

Further, on the pressure surface side and the suction surface side, increases in the pressure difference are suppressed between the pressure-surface-side insert spaces and the pressure-surface-side cavity spaces and between the suction-surface-side insert spaces and the suction-surface-side cavity spaces, thereby suppressing deformation of the insert cylinders.

Furthermore, when deformation of the insert cylinders is suppressed, a reduction in the sealing properties between the division parts and the insert cylinders (gaps between the division parts and the insert cylinders or leakage flow from the gaps) can be suppressed.

When the reduction in the sealing properties between the division parts and the insert cylinders is suppressed, differences in pressure between the pressure-surface-side cavity spaces and the pressure surface side of the outside of the airfoil part and between the suction-surface-side cavity spaces and the suction surface side of the outside of the airfoil part can be maintained within predetermined ranges. Therefore, the velocity of cooling fluid flowing out to the outside of the airfoil part through the film holes can be maintained within a predetermined range, making it possible to ensure the cooling properties based on film cooling.

An increase in force caused by the above-described pressure difference and added to the insert cylinders is suppressed. Therefore, the necessity of fabricating rims or dimples for ensuring the strength of the insert cylinders is reduced, thus suppressing an increase in the plate thickness of the insert cylinders.

In the above-described invention, it is preferable that the partitioning parts have communication holes that connect the pressure-surface-side insert spaces to the suction-surface-side insert spaces.

According to this configuration, even when a change in the operating condition of the gas turbine increases the amount of film-cooling air for the suction surface side of the outer surface of the airfoil part, thus reducing the pressure in the suction-surface-side insert spaces, since cooling air is appropriately supplied from the pressure-surface-side insert spaces through the communication holes, a change in the pressure in the suction-surface-side insert spaces is suppressed, making it possible to reliably carry out film cooling for the suction surface side of the airfoil part.

In the above-described invention, it is preferable that each of the suction-surface-side insert spaces be surrounded by the respective insert cylinder, the respective partitioning part, and pressure adjusting plates disposed on the outer shroud and the inner shroud.

According to this configuration, cooling air supplied to the suction-surface-side insert spaces is adjusted by the pressure adjusting plates to constantly have an appropriate pressure, thereby obtaining good cooling properties of the body and causing no deformation of the inserts.

A gas turbine according to a second aspect of the present invention is provided with a turbine section having the above-described turbine vane.

According to the gas turbine of the second aspect of the present invention, since the above-described turbine vane is included, the cooling properties of impingement cooling and film cooling can be improved.

According to the turbine vane and the gas turbine of the present invention, advantages are afforded in that cooling fluid having different pressures can be supplied to the pressure-surface-side insert spaces and the suction-surface-side insert spaces, thus relieving the thermal stress on the body; and the cooling properties of impingement cooling and film cooling can be improved, thus reducing the amount of cooling air. Further, an advantage is afforded in that deformation of the inserts is suppressed, thus improving the sealing properties.

DETAILED DESCRIPTION OF THE INVENTION

The configurations of a turbine vane and a gas turbine according to a first embodiment of the invention will be described with reference to FIGS. 1 to 3. Note that, in this embodiment, a description will be given of a case where the configuration of the turbine vane of the present invention is applied to a first-stage vane or a second-stage vane in a turbine section of a gas turbine.

Figure 1:
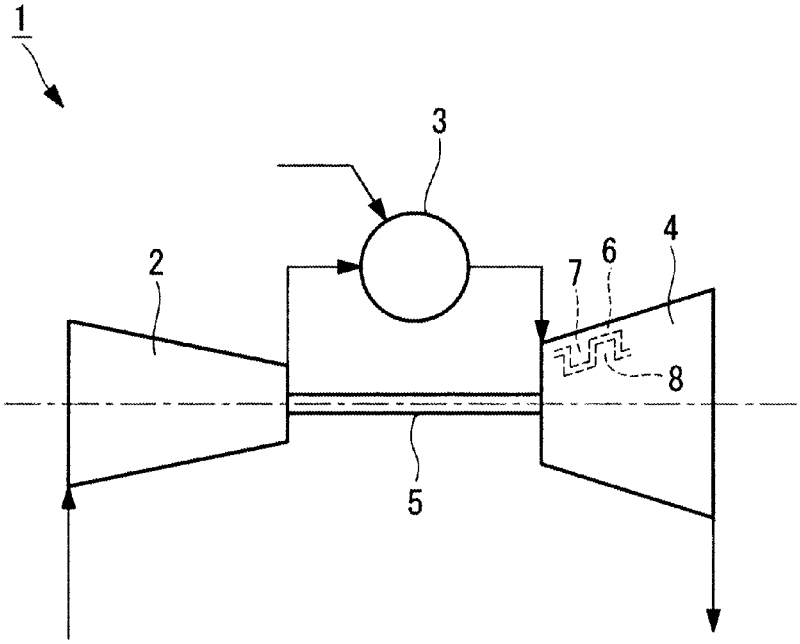
FIG. 1 is a schematic diagram for explaining the configuration of a gas turbine having a turbine vane according to a first embodiment of the present invention.

FIG. 1 is a schematic diagram for explaining the configuration of the gas turbine having the turbine vane according to this embodiment. As shown in FIG. 1, a gas turbine 1 includes a compression section 2, a combustion section 3, a turbine section 4, and a rotary shaft 5.

As shown in FIG. 1, the compression section 2 takes air in from the outside, compresses it, and supplies the compressed air to the combustion section 3. Upon reception of a rotary driving force transferred from the turbine section 4 via the rotary shaft 5, the compression section 2 is rotationally driven, thereby taking air in and compressing the air.

As shown in FIG. 1, the combustion section 3 mixes externally-supplied fuel with the compressed air supplied from the compression section 2, combusts the mixture to produce high-temperature combustion gas, and supplies the produced high-temperature combustion gas to the turbine section 4.

As shown in FIG. 1, the turbine section 4 extracts a rotary driving force from the supplied high-temperature combustion gas, so as to rotationally drive the rotary shaft 5. In the turbine section 4, turbine vane 7 that are fixed to a casing 6 of the gas turbine 1 and turbine blades 8 that are fixed to the rotary shaft 5 and that are rotated together with the rotary shaft 5 are circumferentially arrayed at equal intervals.

The turbine vane 7 and the turbine blades 8 are alternately arrayed toward a downstream direction of the high-temperature combustion gas supplied from the combustion section 3, in the order of the turbine vane 7 and the turbine blade 8. A pair consisting of the turbine vane 7 and the turbine blade 8 is referred to as a stage, and the pairs are counted as a first stage, a second stage, . . . from the combustion section 3 side.

As shown in FIG. 1, the rotary shaft 5 transfers a rotary driving force from the turbine section 4 to the compression section 2. The rotary shaft 5 is provided with the compression section 2 and the turbine section 4.

Cooling air that is partially extracted from the compressed air pressurized in the compression section 2 and that is supplied to the turbine section 4 via an extraction pipe (not shown) is utilized to cool each of the turbine vane 7. The cooling air that has been supplied to the turbine section 4 is supplied to an outer shroud or an inner shroud of the turbine vane 7 via connecting pipes (not shown).

Next, the turbine vane according to the first embodiment of the present invention will be described with reference to FIGS. 2 and 3.

Figure 2:
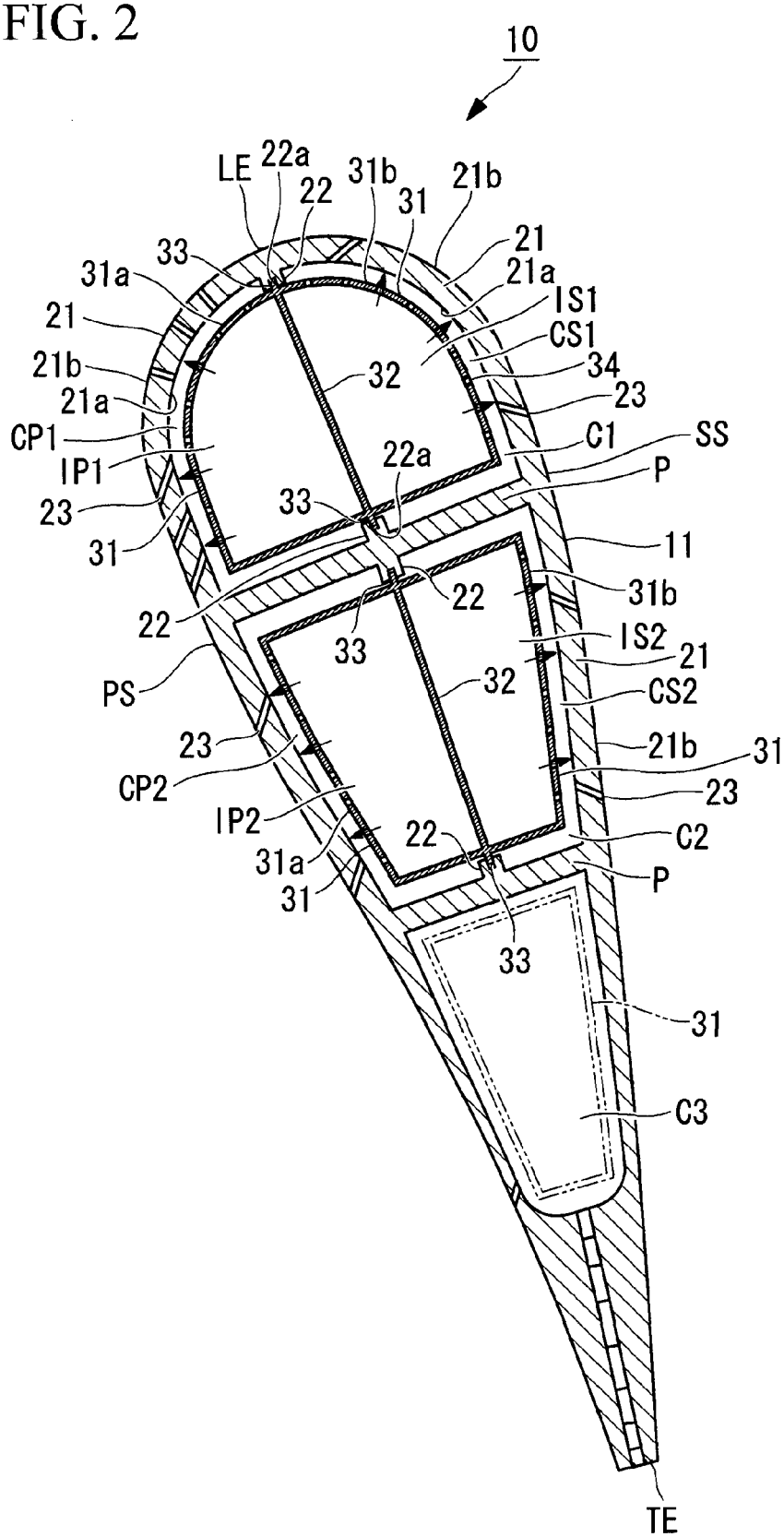
FIG. 2 is a vane longitudinal sectional view for explaining the configuration of the turbine vane shown in FIG. 1.

FIG. 2 is a vane longitudinal sectional view for explaining the configuration of the turbine vane according to this embodiment. FIG. 3 is a vane transverse sectional view of the turbine vane according to this embodiment.

A turbine vane 10 of this embodiment is a vane of the turbine section in the gas turbine and has an impinge-cooling structure and a film-cooling structure.

Figure 3:
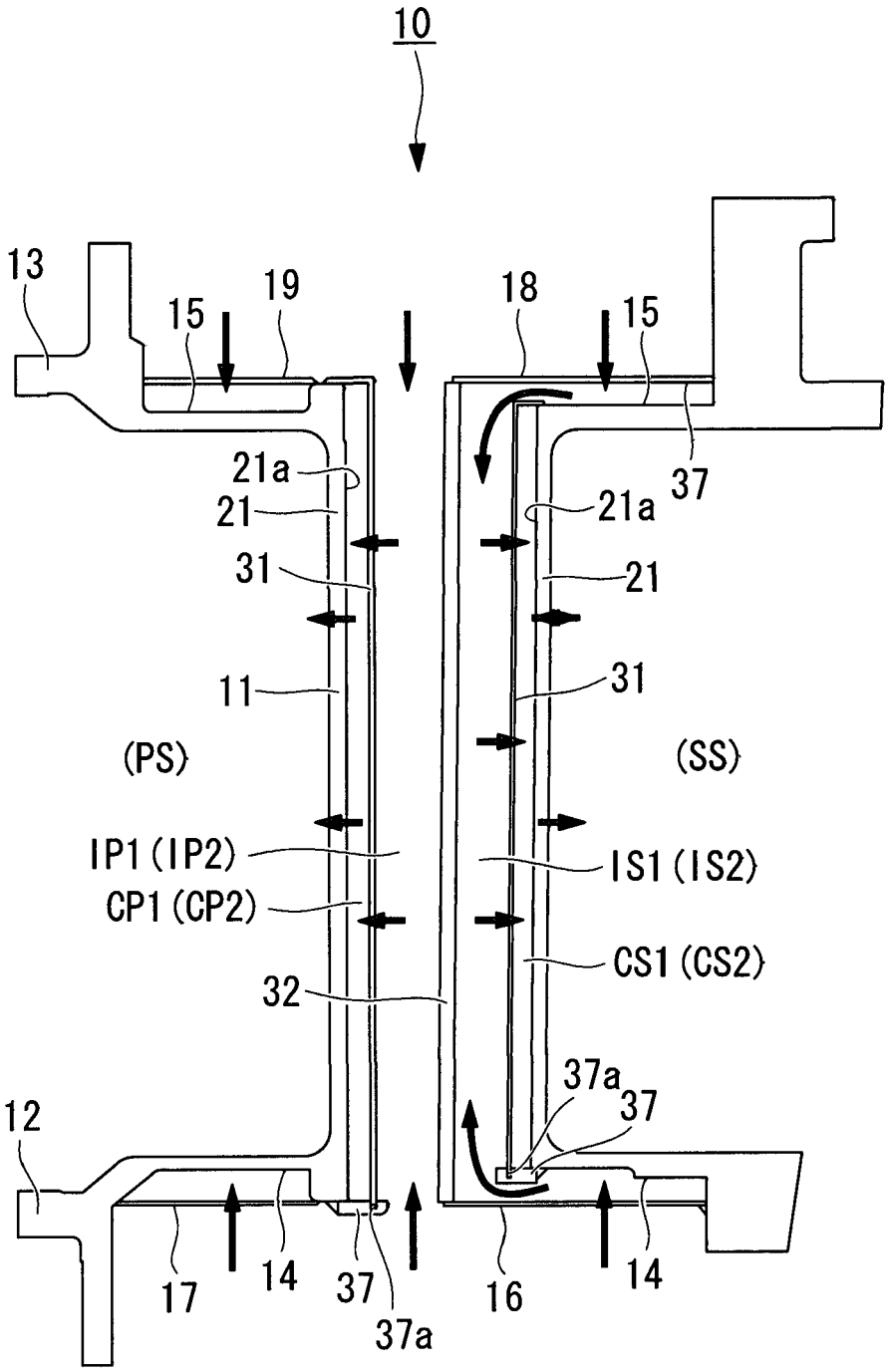
FIG. 3 is a vane transverse sectional view for explaining the configuration of the turbine vane shown in FIG. 1.

As shown in FIGS. 2 and 3, the turbine vane 10 includes, as main components, an airfoil part 11, an inner shroud 12, and an outer shroud 13.

The airfoil part 11 forms the outer shape of a body 21 of the turbine vane 10, and high-temperature combustion gas flows therearound. In FIG. 2, the transverse sectional view of the airfoil part 11 extending in a vane-longitudinal-section direction is shown.

As shown in FIG. 2, the airfoil part 11 is provided with a pressure surface PS, a suction surface SS, a leading edge LE, a trailing edge TE, cooling chambers C1, C2, and C3, sealing dams (division parts) 22, and film holes 23.

Further, a plurality of cooling chambers C1, C2, and C3 are arranged in the airfoil part 11 from the leading edge LE toward the trailing edge TE, and the cooling chambers C1, C2, and C3 are partitioned by plate-like partition walls P. The partition walls P are plate-like members that extend in the vane-transverse-section direction, that extend in a direction intersecting with the pressure surface PS and the suction surface SS, and that are arranged inside the airfoil part 11.

Note that a case where three cooling chambers (C1, C2, and C3) are provided is shown in this embodiment; however, the present invention can also be applied to a case where four or more cooling chambers are provided or a case where two cooling chambers are provided.

As shown in FIG. 2, the pressure surface PS constitutes the outer shape of the body 21 of the airfoil part 11 together with the suction surface SS and is a ventral surface curved in a concave shape.

The suction surface SS constitutes the outer shape of the airfoil part 11 together with the pressure surface PS and is a dorsal surface curved in a convex shape.

As shown in FIG. 2, the leading edge LE is a boundary between the pressure surface PS and the suction surface SS in the airfoil part 11 and is upstream of a combustion gas flow.

The trailing edge TE is a boundary between the pressure surface PS and the suction surface SS in the airfoil part 11 and is downstream of the combustion gas flow.

As shown in FIGS. 2 and 3, the cooling chambers C1, C2, and C3 are spaces in which inserts 31 are disposed and that extend in the vane-longitudinal-section direction of the turbine vane 10. Further, between the cooling chambers C1 and C2 and the inserts 31, pressure-surface-side cavity spaces (cavity spaces) CP1 and CP2 and suction-surface-side cavity spaces (cavity spaces) CS1 and CS2 are formed via the sealing dams 22.

As shown in FIG. 2, the sealing dams 22 are protruding members extending in the vane-longitudinal-section direction along inner walls 21*a* or the partition walls P at the leading edge LE sides and at the trailing edge TE sides of the cooling chambers C1 and C2, and divide the cavity spaces formed between the inserts 31 and the inner walls 21*a* into the pressure-surface-side cavity spaces CP1 and CP2 and the suction-surface-side cavity spaces CS1 and CS2. Further, of pairs of the sealing dams 22, the sealing dams 22 close to the leading edge LE are provided on wall surfaces of the cooling chambers C1 and C2 in the vicinity of the leading edge LE, and the sealing dams 22 close to the trailing edge TE are provided on the partition walls P of the wall surfaces of the cooling chambers C1 and C2.

Concave grooves 22*a* are provided at the center in a cross section of the protruding sealing dams 22, along the vane-longitudinal-section direction. Flange parts 33 that extend from the wall surfaces of the inserts 31 toward the sealing dams 22 in the vane-longitudinal-section direction and in the vane-transverse-section direction are inserted into the concave grooves 22*a*, thereby partitioning the cavity spaces formed between the inserts 31 and the inner walls 21*a* of the body 21 into the pressure-surface-side cavity spaces CP1 and CP2 and the suction-surface-side cavity spaces CS1 and CS2.

Note that, of the cooling chambers C1, C2, and C3, it is unnecessary, in the cooling chamber (C3 in this embodiment) that is closest to the trailing edge TE, to partition the cavity space in the insert 31 into a high-pressure side and a low-pressure side. Specifically, the cooling chamber C3 is provided with neither a partition part of the insert 31 nor sealing dams.

As shown in FIGS. 2 and 3, the film holes 23 are through-holes that are used for film-cooling the turbine vane 10 and that extend from the pressure-surface-side cavity spaces CP or the suction-surface-side cavity spaces CS toward the outside of the turbine vane 10.

The number of the film holes 23 that communicate with the pressure-surface-side cavity spaces CP is determined based on the pressure difference between the pressure of cooling air in the pressure-surface-side cavity spaces CP and the pressure of combustion gas flowing in the vicinity of the pressure surface PS. Similarly, the number of the film holes 23 that communicate with the suction-surface-side cavity spaces CS is determined based on the pressure difference between the pressure of cooling air in the suction-surface-side cavity spaces CS and the pressure of combustion gas flowing in the vicinity of the suction surface SS.

As shown in FIGS. 2 and 3, the inserts 31 are cylindrically-formed members disposed in the cooling chambers C1, C2, and C3, and air for cooling the turbine vane 10 is supplied to the insides thereof.

The inserts 31 are formed to have shapes that are approximately similar to those of the cooling chambers C1, C2, and C3 in which they are disposed, so as to form the cavity spaces between the inserts 31 and the wall surfaces of the cooling chambers C1, C2, and C3.

As shown in FIGS. 2 and 3, the inserts 31 have partition parts 32 at the center thereof to fully partition the inserts 31 into pressure sides and suction sides. Further, impingement holes 34 are provided in the wall surfaces of the inserts 31 that are opposed to the inner walls 21*a* on the pressure surface PS side and on the suction surface SS side.

The partition parts 32 divide insert spaces provided in the inserts 31 into pressure-surface-side insert spaces (insert spaces) IP1 and IP2 and suction-surface-side insert spaces (insert spaces) IS1 and IS2.

The partition parts 32 are plate-like members that extend in the inserts 31 in the vane-longitudinal-section direction (in the direction perpendicular to the plane of the paper of FIG. 2) and that extend from the portions of the inserts 31 brought into contact with the sealing dams 22 close to the leading edge LE toward the sealing dams 22 close to the trailing edge TE.

As shown in FIGS. 2 and 3, the impingement holes 34 are through-holes that are used for impinge-cooling the airfoil part 11 of the turbine vane 10 and that communicate between the pressure-surface-side insert spaces IP1 and IP2 and the pressure-surface-side cavity spaces CP1 and CP2 and that communicate between the suction-surface-side insert spaces IS1 and IS2 and the suction-surface-side cavity spaces CS1 and CS2.

The number of the impingement holes 34 that communicate between the pressure-surface-side insert space IP1 and IP2 and the pressure-surface-side cavity spaces CP1 and CP2 is determined based on the pressure difference of cooling air between the pressure-surface-side insert spaces IP1 and IP2 and the pressure-surface-side cavity spaces CP1 and CP2. Similarly, the number of the impingement holes 34 that communicate between the suction-surface-side insert spaces IS1 and IS2 and the suction-surface-side cavity spaces CS1 and CS2 is determined based on the pressure difference of cooling air between the suction-surface-side insert spaces IS1 and IS2 and the suction-surface-side cavity spaces CS1 and CS2.

Next, a structure for supplying cooling air to the inserts 31 of the turbine vane 10 will be described with reference to FIG. 3. Note that compressed air supplied to the turbine section is utilized as cooling air for the turbine vane and is supplied to the insert spaces from the inner shroud 12 side and the outer shroud 13 side. FIG. 3 is a diagram showing a vane transverse section of the turbine vane 10.

The turbine vane 10 is formed of the airfoil part 11, the inner shroud 12, and the outer shroud 13 and is supported by the casing of the turbine section via the outer shroud 13. Pressure adjusting plates 16, 17, 18, and 19 are disposed on the inner shroud 12 and the outer shroud 13, and the pressure adjusting plates 16 and 18 adjust the pressure in the insert spaces.

Referring to FIGS. 2 and 3, the cooling chamber C1, which is closest to the leading edge LE, will be described in detail, for example. The suction-surface-side insert space IS1 is a space surrounded by a wall surface 31*b* of the insert 31 located at the suction surface side and the partition part 32, and is separated from the outer shroud 13 side by the pressure adjusting plate 18 and is separated from the inner shroud 12 side by the pressure adjusting plate 16.

The pressure adjusting plates 16 and 18 have a number of impingement holes (not shown) and function to reduce the pressure of cooling air introduced to the inner shroud 12 side and the outer shroud 13 side so as to maintain an appropriate pressure in the suction-surface-side insert space IS1.

On the other hand, the pressure-surface-side insert space IP1 is a space surrounded by a wall surface 31*a* of the insert 31 located at the pressure surface PS side and the partition part 32, and is not separated from the inner shroud 12 side or the outer shroud 13 side by pressure adjusting plates or the like. Specifically, cooling air that has been supplied from a compression section via a connecting pipe to the inner shroud 12 side and the outer shroud 13 side is directly supplied to the pressure-surface-side insert space IP1 without passing through pressure adjusting plates.

Further, as shown in FIG. 3, insert receiving plates 37 are secured to inlet portions of the suction-surface-side insert space IS1 and the pressure-surface-side insert space IP1 that are close to the inner shroud 12, along the suction-surface-side inner wall 21*a* and the pressure-surface-side inner wall 21*a* of the body of the airfoil part 11. One ends (in FIG. 3, lower ends) of the inserts 31 are structured to be inserted into the insert receiving plates 37. With this structure, cooling air in the suction-surface-side insert space IS1 is sealed at the inner shroud side, and differences in thermal expansion of the inserts 31 in the vane-longitudinal-section direction are eliminated.

This structure allows the inserts 31 to be extended or contracted in the vane-longitudinal-section direction while eliminating differences in thermal expansion of the inserts 31 in the vane-longitudinal-section direction.

Note that a description has been given above of a structure in which the inserts 31 are secured to the body 21 at the outer shroud 13 side and are provided with, at the inner shroud 12 side, the insert receiving plates 37, which have concave grooves 37*a*; however, in contrast to this structure, a structure may be used in which the inserts 31 are secured to the body 21 at the inner shroud 12 side and are provided with the insert receiving plates 37 at the outer shroud 13 side.

The cooling chamber C1 has been described above as an example, and a similar structure is also applied to the adjacent cooling chamber CS2. Specifically, the suction-surface-side insert space IS2 is surrounded by the suction-surface-side wall surface 31*b* of the insert 31, the partition part 32, and the pressure adjusting plates 16 and 18 provided at the borders with the inner shroud 12 and the outer shroud 13.

On the other hand, a pressure adjusting plate is not disposed between the pressure-surface-side insert space IP2 and the inner shroud 12 or the outer shroud 13, but cooling air is directly introduced to the pressure-surface-side insert space IP2 from the inner shroud 12 side and the outer shroud 13 side.

For the pressure adjusting plate, instead of the impingement holes (not shown) with a number of through-holes, a known technology having another depressurization function, such as a restrictor, can be used; however, the structure thereof is not particularly limited.

Note that cooling passages (not shown) are provided at the edges of the inner shroud 12 and the outer shroud 13 to communicate with spaces surrounded by the pressure adjusting plate 17 and an inner wall 14 of the inner shroud 12 and by the pressure adjusting plate 19 and an inner wall 15 of the outer shroud 13. The pressure adjusting plates 17 and 19 have impingement holes (not shown).

Next, the cooling method of the thus-configured turbine vane 10 and the flow of cooling air will be described with reference to FIGS. 2 and 3.

Air extracted from the compression section 2 of the gas turbine provided with the turbine vane 10 is used for cooling the turbine vane 10. The extracted air for cooling may be directly supplied to the turbine vane 10 as cooling air or may be supplied after it is cooled by a gas cooler or the like; the method of supplying cooling air is not particularly limited.

The cooling air that has been supplied to the turbine section 4 is introduced to the insides of the inner shroud 12 and the outer shroud 13 via connecting pipes (not shown). In this embodiment, a two-sided supply system (two-sided supply structure) in which cooling air is introduced to the cooling chambers C1 and C2 from both sides, i.e., the outer shroud 13 and the inner shroud 12, is employed.

As shown in FIGS. 2 and 3, the cooling air that has been introduced to the inner shroud 12 and the outer shroud 13 is directly introduced to the pressure-surface-side insert spaces IP1 and IP2 without pressure adjustment, and is supplied to the suction-surface-side insert spaces IS1 and IS2 via the pressure adjusting plates 16 and 18. The cooling air flows out toward the inner walls 14 and 15 of the outer shroud 13 and the inner shroud 12 via a number of impingement holes (not shown) provided in the pressure adjusting plates 16 and 18, thus cooling the inner walls 14 and 15. The cooling air that has been used for the impingement cooling is supplied to the suction-surface-side insert spaces IS1 and IS2.

The above-described structure can adjust the pressure of cooling air in the suction-surface-side insert spaces IS1 and IS2, can maintain an appropriate pressure difference between the suction-surface-side insert spaces IS1 and IS2 and the suction-surface-side cavity spaces CS1 and CS2, and can also maintain an appropriate pressure difference between the pressure-surface-side cavity spaces CP1 and CP2 and the suction-surface-side cavity spaces CS1 and CS2. As a result, excessive impingement cooling applied to the suction surface SS of the body is suppressed, and the thermal stress thereon is relieved.

Note that the cooling air introduced to the inner shroud 12 and the outer shroud 13 and supplied to the space surrounded by the pressure adjusting plate 17 and the inner wall 14 of the inner shroud 12 and the space surrounded by the pressure adjusting plate 19 and the inner wall 15 of the outer shroud 13 via the pressure adjusting plates 17 and 19 is used to cool the inner walls 14 and 15 of the inner shroud 12 and the outer shroud 13, is introduced to the cooling passages (not shown) of the outer shroud 13 and the inner shroud 12, is used for cooling the edges of the inner shroud 12 and the outer shroud 13, and is then discharged into the combustion gas.

The cooling air supplied to the pressure-surface-side insert spaces IP1 and IP2 and the suction-surface-side insert spaces IS1 and IS2 blows out through the impingement holes 34 provided in the inserts 31 toward the pressure-surface-side cavity spaces CP1 and CP2 and the suction-surface-side cavity spaces CS1 and CS2.

The cooling air in the pressure-surface-side insert spaces IP1 and IP2 blows out toward the pressure-surface-side cavity spaces CP1 and CP2 because of the pressure difference with respect to the pressure-surface-side cavity spaces CP1 and CP2, and collides with the inner walls 21*a*, which constitute the cooling chambers C1 and C2. Therefore, the body 21 (the inner walls 21*a*) of the turbine vane 10 is cooled.

In this embodiment, in order to maintain an appropriate film pressure difference, it is necessary to maintain the pressure of cooling air in the pressure-surface-side cavity spaces CP1 and CP2 higher than the pressure of cooling air in the suction-surface-side cavity spaces CS1 and CS2. Therefore, an appropriate density of the number of the impingement holes 34 that communicate between the pressure-surface-side insert spaces IP1 and IP2 and the pressure-surface-side cavity spaces CP1 and CP2 is specified.

In the same way, the cooling air in the suction-surface-side insert spaces IS1 and IS2 blows out toward the suction-surface-side cavity spaces CS1 and CS2 because of the pressure difference with respect to the suction-surface-side cavity spaces CS1 and CS2, and collides with the inner walls 21*a*, which constitute the cooling chambers C1 and C2.

Specifically, in order to maintain an appropriate film pressure difference in the suction surface SS side, it is necessary to maintain the pressure of cooling air in the suction-surface-side cavity spaces CS1 and CS2 lower than that in the pressure-surface-side cavity spaces CP1 and CP2. Therefore, an appropriate density of the number of the impingement holes 34 that communicate between the suction-surface-side insert spaces IS1 and IS2 and the suction-surface-side cavity spaces CS1 and CS2 is specified.

Since the pressure-surface-side cavity spaces CP1 and CP2 and the suction-surface-side cavity spaces CS1 and CS2 are divided by the sealing dams 22, the pressure-surface-side cavity spaces CP1 and CP2 and the suction-surface-side cavity spaces CS1 and CS2 can be filled with cooling air having different pressures, as described above.

The cooling air used for impingement cooling then flows out from the pressure-surface-side cavity spaces CP1 and CP2 and the suction-surface-side cavity spaces CS1 and CS2 to the outside of the airfoil part 11 via the film holes 23 and is used for film cooling.

The cooling air in the pressure-surface-side cavity spaces CP1 and CP2 flows out to the outside of the pressure surface PS of the body via the film holes 23 because of the pressure difference with respect to combustion gas flowing in the vicinity of the pressure surface PS of the airfoil part 11. The flowing-out cooling air flows along the pressure surface PS while forming a film-like layer, thereby film-cooling an outer wall 21*b* of the body 21 of the turbine vane 10.

With this configuration, cooling air having different pressures can be supplied to the pressure-surface-side insert spaces IP1 and IP2 and the suction-surface-side insert spaces IS1 and IS2. Therefore, it is possible to suppress an increase in the pressure difference between the pressure-surface-side insert spaces IP1 or IP2 and the pressure-surface-side cavity spaces CP1 or CP2 and an increase in the pressure difference between the suction-surface-side insert spaces IS1 or IS2 and the suction-surface-side cavity spaces CS1 or CS2, and to suppress the deformation of the inserts 31.

When the deformation of the inserts 31 is suppressed, contact surfaces are maintained between the concave grooves 22*a* provided in the sealing dams 22 and the flange parts 33 of the inserts 31. When the contact surfaces are formed, it is possible to suppress a reduction in the sealing properties between the sealing dams 22 and the inserts 31 and to improve the cooling properties of impingement cooling and film cooling.

When a reduction in the sealing properties between the sealing dams 22 and the inserts 31(gaps between the sealing dams 22 and the inserts 31 or leakage flow from the gaps) is suppressed, the pressure difference between the pressure of cooling air in the pressure-surface-side cavity spaces CP1 and CP2 and the pressure of combustion gas flowing in the vicinity of the pressure surface PS and the pressure difference between the pressure of cooling air in the suction-surface-side cavity spaces CS1 and CS2 and the pressure of combustion gas flowing in the vicinity of the suction surface SS can be kept within predetermined ranges. Therefore, the flow velocity of cooling air flowing out to the outside of the airfoil part 11 through the film holes 23 can be kept within a predetermined range, making it possible to ensure the cooling properties based on film cooling.

Further, an increase in force caused by the above-mentioned pressure difference and added to the inserts 31 is suppressed. Therefore, the necessity of fabricating rims or dimples to ensure the strength of the inserts 31 is reduced, and an increase in the plate thickness of the inserts 31 can be suppressed. Therefore, a deterioration in manufacturability of the inserts can be prevented.

On the other hand, an increase in the difference in the pressure of cooling air between the suction-surface-side insert spaces IS1 and IS2 and the suction-surface-side cavity spaces CS1 and CS2 is suppressed, making it possible to increase the number of the impingement holes 34 and to improve the cooling properties based on impingement cooling.

Next, the configuration of a gas turbine vane according to a second embodiment of the present invention will be described with reference to FIGS. 4 and 5. Note that, in this embodiment, the present invention can also be applied to a first-stage vane or a second-stage vane, as in the first embodiment.

A turbine vane 40 of this embodiment uses a different method of supplying cooling air to the suction-surface-side insert spaces IS1 and IS2, compared with the turbine vane 10 of the first embodiment.

Figure 4:
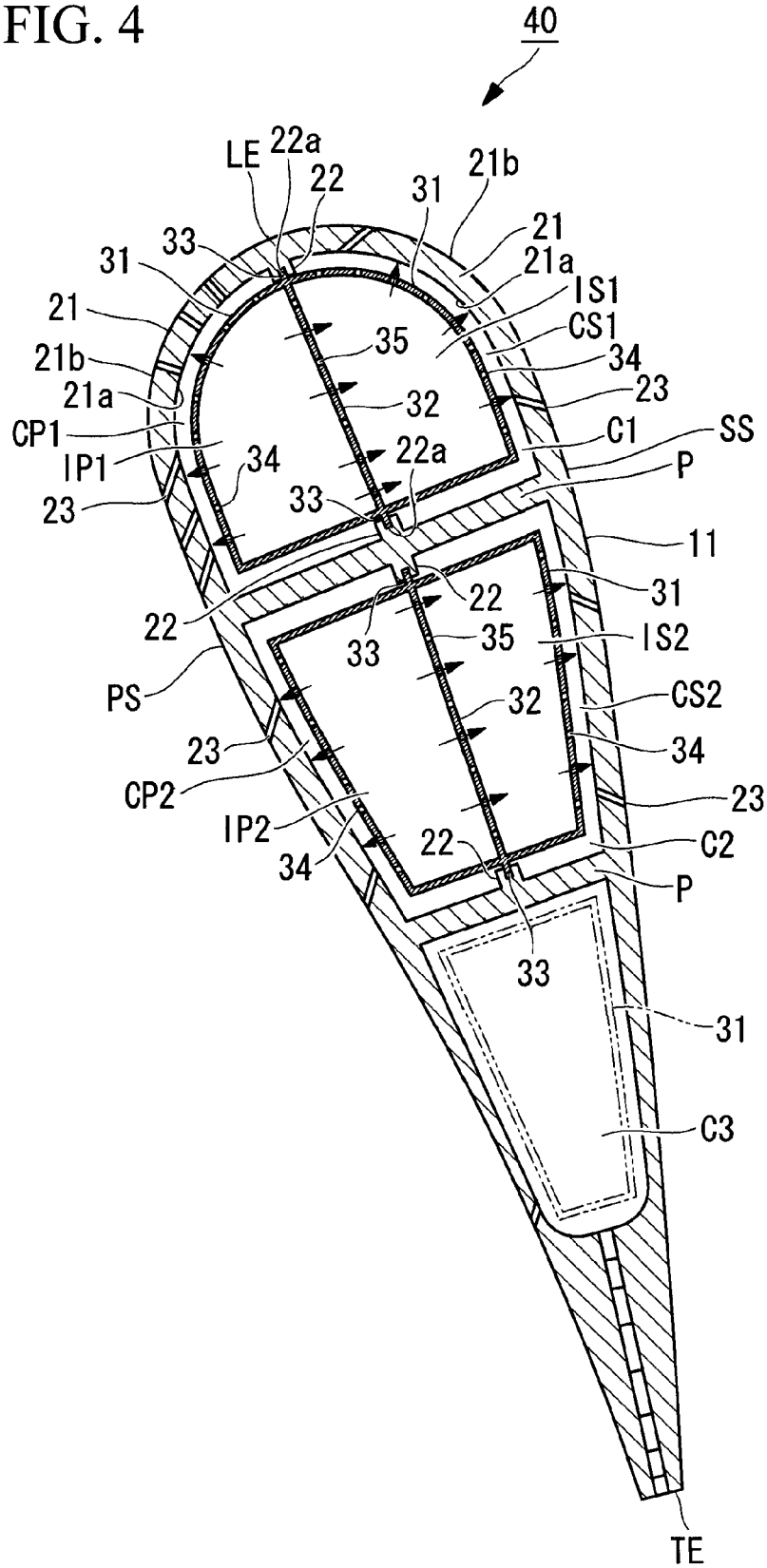
FIG. 4 is a vane longitudinal sectional view for explaining the configuration of a turbine vane according to a second embodiment of the present invention.
Figure 5:
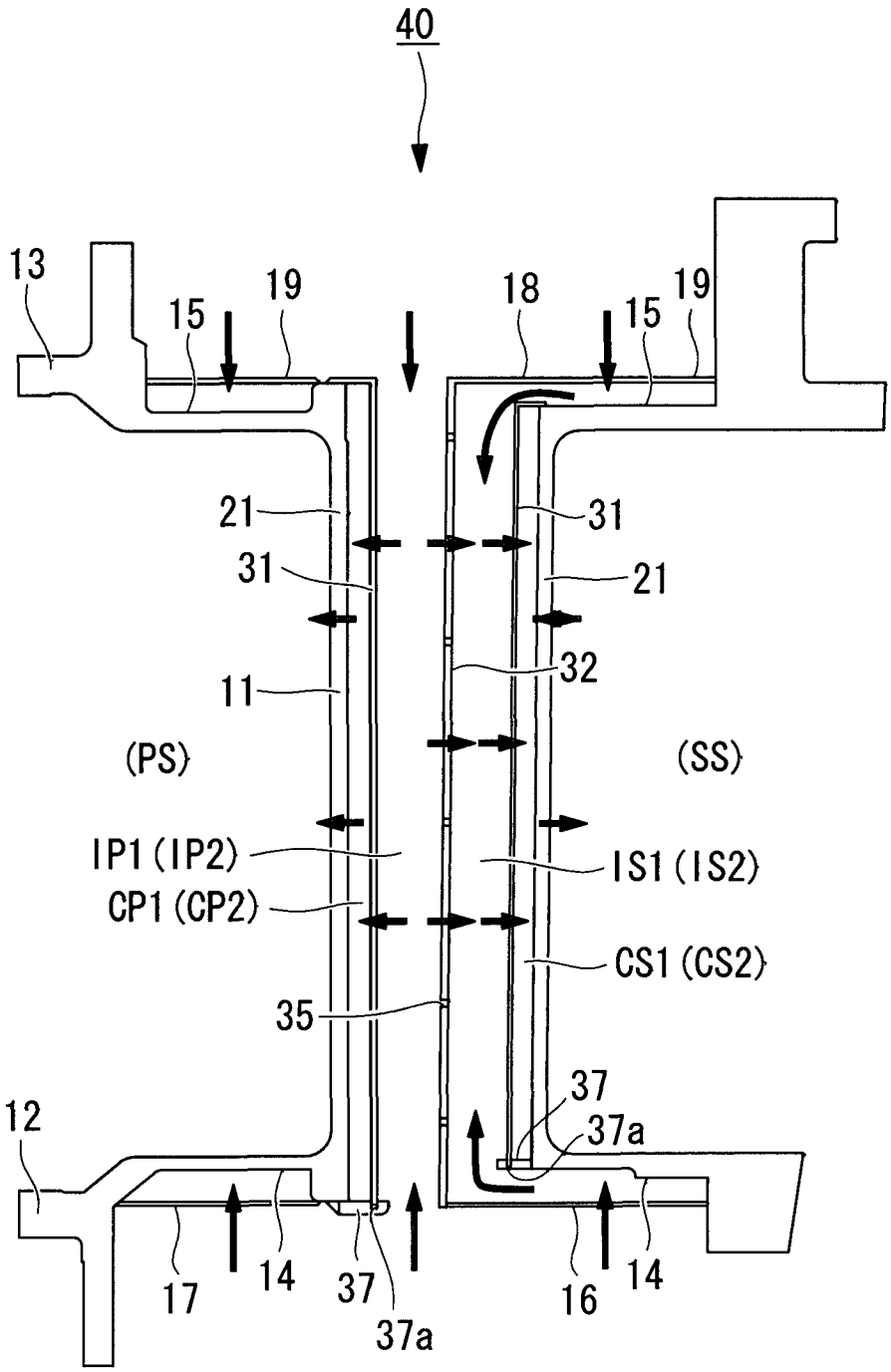
FIG. 5 is a vane transverse sectional view for explaining the configuration of the turbine vane shown in FIG. 4.

Specifically, the difference therebetween is that communication holes 35 that communicate between the pressure-surface-side insert space IP1 and IP2 and the suction-surface-side insert spaces IS1 and IS2 are provided in the partition parts 32 of the inserts 31 disposed in the cooling chambers C1 and C2, as shown in FIGS. 4 and 5. The other structures are the same as those of the first embodiment. For names and reference symbols common to those in the first embodiment, names and reference symbols identical to those in the first embodiment are used.

The cooling-air supplying structure and the flow of cooling air in this embodiment will be described below.

As shown in FIGS. 4 and 5, the main flow of cooling air supplied to the suction-surface-side insert spaces IS1 and IS2 is the same as that of the first embodiment. Specifically, cooling air that has been supplied from the compression section to the outer shroud 13 and the inner shroud 12 is supplied from both sides, i.e., the outer shroud 13 and the inner shroud 12, to the suction-surface-side insert spaces IS1 and IS2 via the pressure adjusting plates 16 and 18 having impingement holes (not shown) (two-sided supply system and two-sided supply structure). Furthermore, the cooling air supplied to the suction-surface-side insert spaces IS1 and IS2 blows out to the suction-surface-side cavity spaces CS1 and CS2 via the impingement holes 34 provided in the inserts 31, and is used to cool the inner walls 21*a* of the body 21. The cooling air that has been used for the impingement cooling is used to film-cool the outer surface of the airfoil part 11 when blowing out into combustion gas via the film holes 23 provided in the body 21.

The flow of cooling air in the pressure-surface-side insert spaces IP1 and IP2 is the same as the above-described flow of cooling air supplied to the suction-surface-side insert spaces IS1 and IS2.

On the other hand, in this embodiment, part of the cooling air supplied to the pressure-surface-side insert spaces IP1 and IP2 is introduced to the suction-surface-side insert spaces IS1 and IS2 via the communication holes 35 provided in the partition parts 32.

However, when the amount of film-cooling air for the suction surface SS side of the airfoil part 11 is increased because of a change in the operating condition of the gas turbine, a situation can occur in which the pressure (static pressure) in the suction-surface-side insert spaces IS1 and IS2 is reduced, a required amount of impingement-cooling air blowing out from the suction-surface-side insert spaces IS1 and IS2 to the suction-surface-side cavity spaces CS1 and CS2 cannot be ensured, and thus cooling of the body is not sufficiently carried out.

In this embodiment, in order to solve this problem, the communication holes 35 are provided in the partition parts 32. Specifically, cooling air is supplied to the suction-surface-side insert spaces IS1 and IS2 mainly from the outer shroud 13 and the inner shroud 12 via the pressure adjusting plates 16 and 18 having the impingement holes; however, a structure is formed in which part of cooling air in the pressure-surface-side insert spaces IP1 and IP2 can be supplied to the suction-surface-side insert spaces IS1 and IS2 via the communication holes 35 provided in the partition parts 32, preventing a reduction in pressure in the suction-surface-side insert spaces IS1 and IS2.

In other words, the communication holes 35 provided in the partition parts 32 have a pressure adjusting function of supplying, when the pressure in the suction-surface-side insert spaces IS1 and IS2 is reduced, cooling air from the pressure-surface-side insert spaces IP1 and IP2 by using the pressure difference between the pressure-surface-side insert spaces and the suction-surface-side insert spaces; of suppressing a reduction in pressure in the suction-surface-side insert spaces IS1 and IS2; and of recovering the pressure.

When the pressure in the suction-surface-side insert spaces IS1 and IS2 is stabilized, film cooling for the outer surface of the airfoil part is reliably carried out. Further, since an appropriate film pressure difference between the suction-surface-side cavity spaces CS1 and CS2 and combustion gas is maintained with respect to a change in the operating condition of the gas turbine, the amount of cooling air in the suction surface side of the body is optimized, and the amount of cooling air for the entire vane can be minimized.

Note that, in this embodiment, part of cooling air introduced to the inner shroud 12 and the outer shroud 13 is used to cool the edges of the inner shroud 12 and the outer shroud 13 (not shown) via the pressure adjusting plates 17 and 19, as in the first embodiment.

Figure 6:
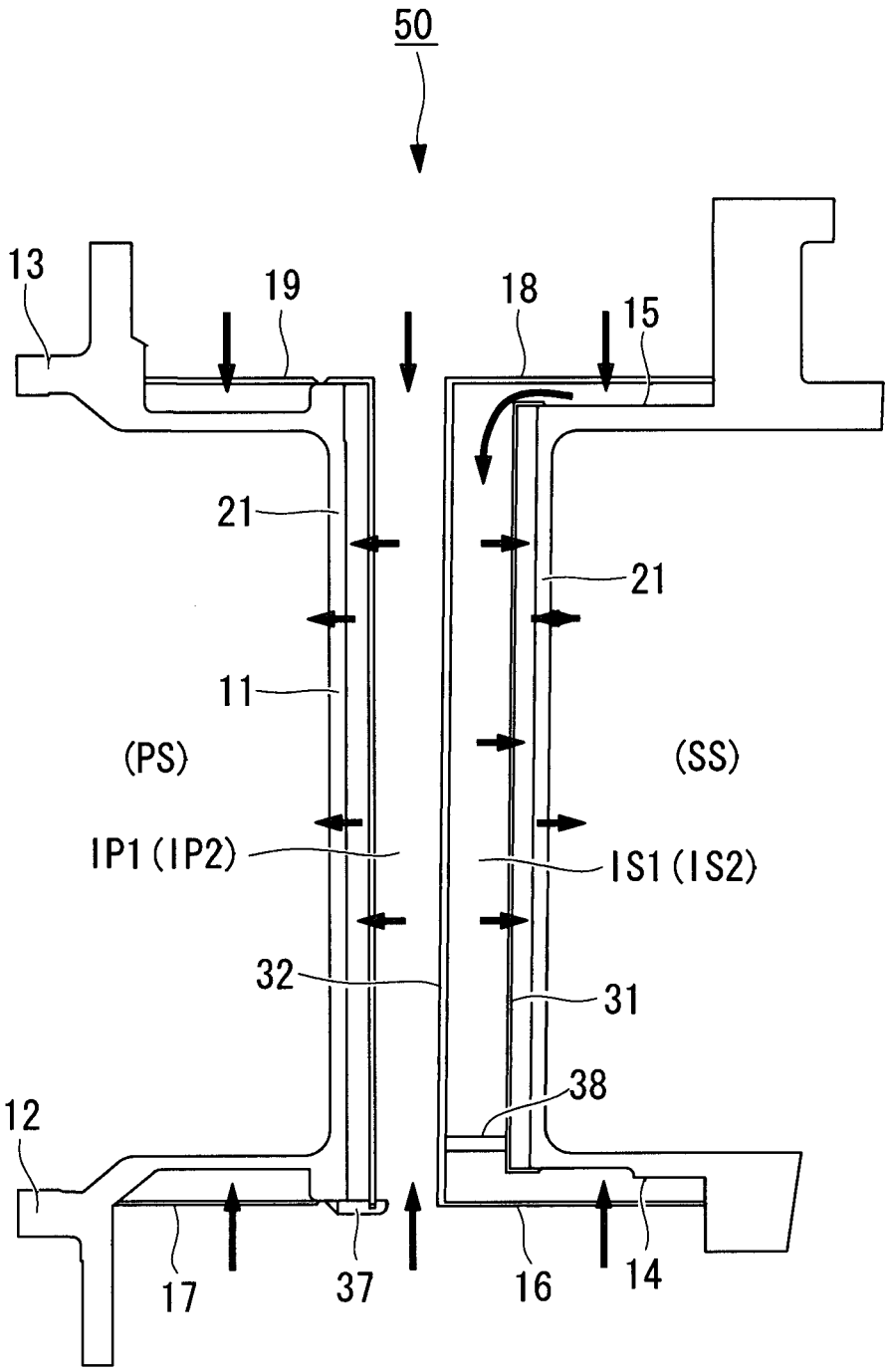
FIG. 6 is a vane longitudinal sectional view for explaining the configuration of a turbine vane according to a third embodiment of the present invention.
Figure 7:
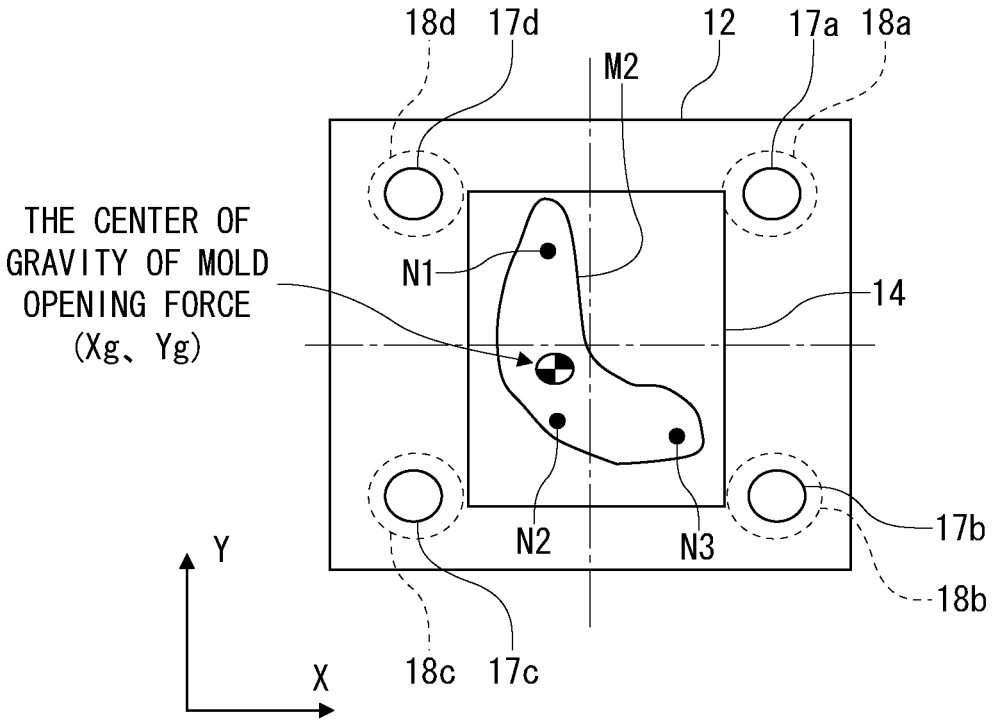
FIG. 7 PRIOR ART
FIG. 7 is a vane transverse sectional view showing the configurations of inserts of a conventional turbine vane.

Next, the configuration of a gas turbine vane according to a third embodiment of the present invention will be described with reference to FIG. 6. FIG. 6 is a vane longitudinal sectional view of the turbine vane according to the third embodiment. Note that, in this embodiment, the present invention can also be applied to a first-stage vane or a second-stage vane, as in the first and second embodiments.

In the first and second embodiments, the two-sided supply system is used, in which cooling air is supplied to the suction-surface-side insert spaces IS1 and IS2 from both sides, i.e., the outer shroud 13 and the inner shroud 12, via the pressure adjusting plates (via the partition parts 32 in the second embodiment); however, this embodiment differs from the other embodiments in that a one-sided supply system is employed.

As shown in FIG. 6, a turbine vane 50 according to this embodiment differs from those of the first and second embodiments in that, instead of the insert receiving plates 37, an insert partitioning plate 38 is provided at an inlet portion of the suction-surface-side insert space IS1 in the cooling chamber C1 that is close to the inner shroud 12.

Specifically, when the insert partitioning plate 38 is provided at the inner shroud 12 side, the inner shroud 12 side and the suction-surface-side insert space IS1 are separated.

Note that since the other components are the same as those of the above-described embodiments, a description of those components is omitted here.

In this embodiment, as shown in FIG. 6, one side (upper side in FIG. 6) of the suction-surface-side insert space IS1 in the cooling chamber C1 communicates with the outer shroud 13 via the pressure adjusting plate 18, and the other side (lower side in FIG. 6) thereof is blocked by the insert partitioning plate 38 secured to one end (lower end in FIG. 6) of the insert 31.

On the other hand, one side of the suction-surface-side insert space IS2 in the cooling chamber CS2 communicates with the inner shroud 12 via the pressure adjusting plate 16, and the other side thereof is blocked by an insert partitioning plate (not shown) secured to an end (upper end in FIG. 6) of the insert 31, in contrast to the suction-surface-side insert space IS1.

Specifically, the suction-surface-side insert space IS1 is supplied with only cooling air that has been used for impingement cooling at the pressure adjusting plate 18 on the outer shroud 13, and is not supplied with cooling air from the inner shroud 12 side because the inner shroud 12 side is blocked.

On the other hand, the suction-surface-side insert space IS2 is supplied with only cooling air that has been used for impingement cooling at the pressure adjusting plate 16 on the inner shroud 12, and is not supplied with cooling air from the outer shroud 13 side because the outer shroud 13 side is blocked. A so-called "one-sided supply structure" is employed.

Note that, in this embodiment, the "one-sided supply structure" may be employed, in which one side of the suction-surface-side insert space IS1 communicates with the inner shroud 12 via the pressure adjusting plate 16 and the other side thereof is blocked by the insert partitioning plate 38 secured to an end of the insert 31 close to the outer shroud 13; and one side of the adjacent suction-surface-side insert space IS2 communicates with the outer shroud 13 and the other side thereof is blocked by an insert partitioning plate (not shown) secured to an end of the insert 31.

Further, even when the turbine vane 50 includes four or more cooling chambers, the one-sided supply structure can be used; however, a combination of whether to supply cooling air from either the outer shroud or the inner shroud and whether to supply the cooling air to which suction-surface-side insert space is basically determined as desired.

However, it is desirable to have a one-sided supply structure in which adjacent suction-surface-side insert spaces are supplied with cooling air from different shrouds (the outer shroud and the inner shroud). This is because drift of cooling air to be supplied to the suction-surface-side insert spaces is avoided.

Note that, in FIG. 6, a description has been given with reference to the vane longitudinal sectional view of the first embodiment; a similar description may be given with reference to that of the second embodiment.

According to the turbine vane 50 of this embodiment, the insert partitioning plate 38 is secured tightly to an insert 31 to ensure the sealing properties at a junction of the insert partitioning plate 38 and the insert 31, thus reliably preventing the leakage of cooling air from the junction.

Further, since cooling air is sealed by the insert partitioning plate 38 in this embodiment, the leakage of cooling air can be further reduced compared with the first and second embodiments.

Note that since other effects and advantages are the same as those of the first second embodiments, a description thereof is omitted here.

What is claimed is:

1. A turbine vane comprising: an outer shroud; an airfoil part that has a pressure surface curved in a concave shape and a suction surface curved in a convex shape; and an inner shroud that is connected to the outer shroud via the airfoil part, wherein the airfoil part comprises:

cooling chambers that are spaces into which the inside of the airfoil part is partitioned, from a leading edge side to a trailing edge side of the airfoil part, by a partition wall, and that extend in a vane-longitudinal-section direction;

insert cylinders each of which is disposed in each of the cooling chambers and each of which has a plurality of impingement holes on the pressure surface side and the suction surface side of the insert cylinder;

film holes that are provided in the pressure surface side and the suction surface side of the vane body; and a pair of division parts provided on a leading edge side and a trailing edge side of an inner surface of each of the cooling chambers, for dividing a cavity space, which is formed between the inner surface of each cooling chamber and an outer surface of each insert cylinder, into a pressure-surface-side cavity space close to the pressure surface and a suction-surface-side cavity space close to the suction surface, wherein each of the insert cylinders comprises a partitioning part that extends from the leading edge side to the trailing edge side and that extends in the vane-longitudinal-section direction, wherein the inside of each of the insert cylinders is partitioned into a pressure-surface-side insert space close to the pressure surface and a suction-surface-side insert space close to the suction surface, and wherein the partitioning part extends directly between the pair of division parts.

2. A turbine vane according to claim 1, wherein the partitioning parts have communication holes that connect the pressure-surface-side insert spaces to the suction-surface-side insert spaces.

3. A turbine vane according to claim 1, wherein each of the suction-surface-side insert spaces is surrounded by the respective insert cylinder, the respective partitioning part, and pressure adjusting plates disposed on the outer shroud and the inner shroud.

4. A gas turbine comprising a turbine section having a turbine vane supported by a turbine casing, wherein the turbine vane comprises: an outer shroud that is supported by the turbine casing; an airfoil part that has a pressure surface curved in a concave shape and a suction surface curved in a convex shape; and an inner shroud that is connected to the outer shroud via the airfoil part, wherein the airfoil part comprises:

cooling chambers that are spaces into which the inside of the airfoil part is partitioned, from a leading edge side to a trailing edge side of the airfoil part, by a partition wall, and that extend in a vane-longitudinal-section direction;

insert cylinders each of which is disposed in each of the cooling chambers and each of which has a plurality of impingement holes on the pressure surface side and the suction surface side of the insert cylinder;

film holes that are provided in the pressure surface side and the suction surface side of the vane body; and a pair of division parts provided on a leading edge side and a trailing edge side of an inner surface of each of the cooling chambers, for dividing a cavity space, which is formed between the inner surface of each cooling chamber and an outer surface of each insert cylinder, into a pressure-surface-side cavity space close to the pressure surface and a suction-surface-side cavity space close to the suction surface, wherein each of the insert cylinders comprises a partitioning part that extends from the leading edge side to the trailing edge side and that extends in the vane-longitudinal-section direction, wherein the inside of each of the insert cylinders is partitioned into a pressure-surface-side insert space close to the pressure surface and a suction-surface-side insert space close to the suction surface, and, wherein the partitioning part extends directly between the pair of division parts.

5. A turbine vane according to claim 1, wherein the insert cylinders have a plurality of pressure-surface-side impingement holes that are connected to a pressure-surface-side insert space, and a plurality of suction-surface-side impingement holes that are connected to a suction-surface-side insert space.

* * * * *